US010286663B2

(12) United States Patent
Verzijl et al.

(10) Patent No.: US 10,286,663 B2
(45) Date of Patent: May 14, 2019

(54) EJECTION DEVICE WITH UNIFORM EJECTION PROPERTIES

(71) Applicant: Océ Holding B.V., Venlo (NL)

(72) Inventors: Klaas Verzijl, Venlo (NL); Norbert H. W. Lamers, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 15/819,293

(22) Filed: Nov. 21, 2017

(65) Prior Publication Data

US 2018/0147847 A1 May 31, 2018

(30) Foreign Application Priority Data

Nov. 29, 2016 (EP) ..... 16201186

(51) Int. Cl.
*B41J 2/16* (2006.01)
*B41J 2/14* (2006.01)
*B41J 2/145* (2006.01)

(52) U.S. Cl.
CPC ..... *B41J 2/14274* (2013.01); *B41J 2/145* (2013.01); *B41J 2/14233* (2013.01); *B41J 2/161* (2013.01); *B41J 2/1626* (2013.01); *B41J 2202/08* (2013.01); *B41J 2202/11* (2013.01)

(58) Field of Classification Search
CPC .... B41J 2/14274; B41J 2/14233; B41J 2/145; B41J 2/161
USPC ..... 347/40, 54, 68, 70
See application file for complete search history.

(56) References Cited

U.S. PATENT DOCUMENTS 5,132,702 A 7/1992 Shiozaki et al.
7,699,444 B2 * 4/2010 Takahashi ..... B41J 2/04581 347/68
8,985,746 B2 * 3/2015 Kubota ..... B41J 2/14209 347/68
10,093,097 B2 * 10/2018 Shklyarevskiy ..... B41J 2/155
2004/0130601 A1 7/2004 Shimada
2007/0279455 A1 12/2007 Karlinski et al.
(Continued)

FOREIGN PATENT DOCUMENTS

EP 1 493 575 A1 1/2005
JP 9-156096 A 6/1997
WO WO 2012/175593 A1 12/2012

OTHER PUBLICATIONS

Search Report, issued in European application No. 16 20 1186, dated May 11, 2017.

*Primary Examiner* — An H Do
(74) *Attorney, Agent, or Firm* — Birch, Stewart, Kolasch & Birch, LLP

(57) ABSTRACT

An ejection device includes a tile made of a material having a first coefficient of thermal expansion (CTE). The tile carries a chip that forms a plurality of ejection units and is in thermal contact with the tile. The chip is mainly made of a material having a second CTE different from the first CTE, wherein each ejection unit is capable of ejecting droplets of a liquid and comprises a pressure chamber and a flexible wall delimiting the pressure chamber. The flexible wall has a deformation compliancy that depends upon at least one mechanical design parameter of the chip. In operation at a temperature different from room temperature, the ejection units have uniform ejection properties, while the compliancies of the flexible walls of at least two of the ejection units are different from one another at room temperature.

12 Claims, 6 Drawing Sheets

(56) References Cited

U.S. PATENT DOCUMENTS

| | | | |
|---|---|---|---|
| 2008/0030553 | A1 | 2/2008 | Takahashi |
| 2011/0234703 | A1 | 9/2011 | Kodoi |

* cited by examiner

EJECTION DEVICE WITH UNIFORM EJECTION PROPERTIES

The invention relates to an ejection device comprising a tile made of a material having a first coefficient of thermal expansion (CTE), the tile carrying a chip that forms a plurality of ejection units and is in thermal contact with the tile, the chip being mainly made of a material having a second CTE different from the first CTE, wherein each ejection unit is capable of ejecting droplets of a liquid and comprises a pressure chamber and a flexible wall delimiting the pressure chamber, the flexible wall having a deformation compliancy that depends upon at least one mechanical design parameter of the chip, and wherein, in operation at a temperature different from room temperature, the ejection units and have uniform ejection properties.

More particularly, the invention relates to an ink jet print head wherein the chip is a MEMS-chip (micro-electro-mechanical system).

Depending upon the type of print process, it is frequently required that the chip operates at a temperature that is different from room temperature so that the chip needs to be cooled or—in most cases—heated. Since it is difficult to accommodate a heater on the chip, it is preferred that there is a good thermal contact between the chip and the tile so that the heater may be applied to the tile and the heat will then be transferred onto the chip.

On the other hand, the chip is required to have a relatively large window permitting to supply marking material such as ink to the printing elements. As a consequence, the chip can engage the tile only on a relatively small surface at the edge of the window, which compromises the heat transfer to the chip.

The chip is typically made of a material such as silicon or ceramics, whereas the tile may be made of a less expensive material such as graphite which, however, has a CTE that is substantially different from that of the chip. As a consequence, the tile and the chip are subject to differential thermal expansion which induces a mechanical stress in the chip. This mechanical stress may compromise the print quality. For example, in case of a piezoelectric ink jet print head, each ejection unit has a flexible wall (membrane) which is deflected by means of a piezoelectric actuator so as to create an acoustic pressure wave in the ink and thereby to cause an ink droplet to be expelled from a nozzle. The mechanical stress in the chip changes the tension of the membrane and thereby has an influence on the jetting behavior of the ejection units. Since the mechanical (tensile or compressive depending inter alia on the CTE difference) stress tends to be largest at the ends of an elongated chip, the ejection properties of the ejection units become non-uniform, and this results in a non-uniform appearance of the printed image.

In order to reduce the mechanical stress, it is generally possible to bond the chip to the tile by means of a relatively thick layer of adhesive which can allow for differential thermal expansion of the tile and the chip and thereby reduce the mechanical stress. However, an increased thickness of the adhesive layer compromises the transfer of heat from the tile to the chip so that a reasonable compromise had to be made in conventional designs.

U.S. Pat. No. 5,132,702 A and US 2011/234703 A1 disclose thermal ink jet print heads in which non-uniformities in the ejection properties are smoothened-out by appropriately adapting the power pulses which control the various actuators which cause the droplets to be jetted-out, or by appropriately adapting the flow resistance of the passages through which the liquid flows from the pressure chambers to respectively associated nozzles.

It is an object of the invention to provide an ejection device which can be manufactured at low costs and is capable of achieving uniform ejection properties at operating temperature.

In order to achieve this object, according to the invention, the compliancies of the flexible walls of at least two of the ejection units are different from one another at room temperature.

According to the invention, non-uniformities in the compliancies of the flexible walls are created on purpose in order to compensate for the effect of the temperature-dependent mechanical stress. Thus, when the temperature of the chip changes from room temperature to the operating temperature, the mechanical stresses induced by the temperature change will change the compliancies of the flexible walls in the individual ejection units such that a more uniform compliancy distribution is obtained.

Useful optional features of the invention are indicated in the dependent claims.

A large variety of different mechanical design parameters of the chip may be used for controlling the compliancies. These parameters include for example the thickness and/or the material of the flexible wall, the dimension (e.g. length and width) of a flexing part of the flexible wall, the length, width or thickness of a piezoelectric actuator that is attached to the flexible wall, thicknesses of contact layers, moisture shielding layers, electrode layers, and the like.

The invention also relates to a method of manufacturing the ejection device. Typically, photolithographic techniques are used for manufacturing the (MEMS) chip. The chip has a layered structure, and the manufacturing process comprises several steps of applying etch masks to the various layers of the chip and then selectively etching certain areas of these layers. In the method according to the invention, the mechanical design parameter which is used for controlling the compliancies of the flexible walls is selected to be a parameter that is determined by only a single etch mask. Thus, in order to obtain a chip according to the invention, only one of the various etch masks needs to be modified in order to obtain different compliancies of the flexible walls of the various ejection units.

Embodiment examples will now be described in conjunction with the drawings, wherein.

Figure 1:
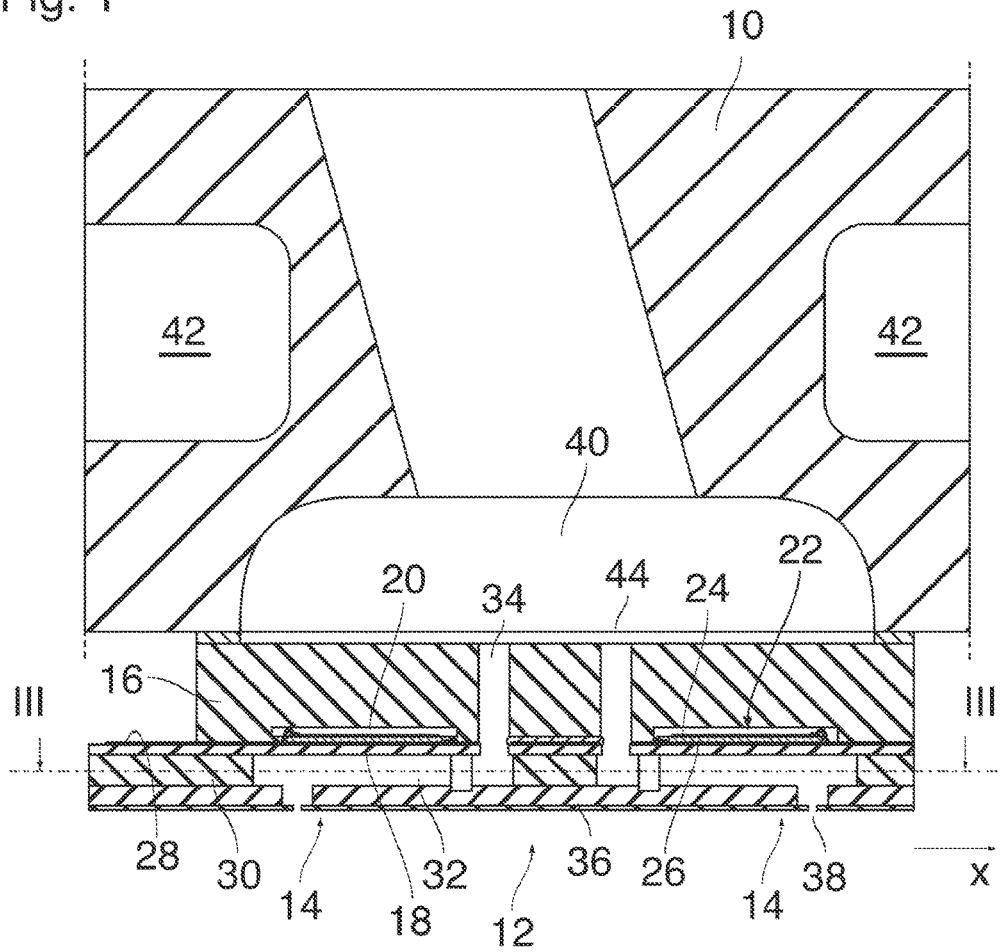
FIG. 1 is a cross-sectional view of a part of an ejection device comprising a chip with a plurality of ejection units.

FIG. 1 shows a part of an ejection device, a piezoelectric ink jet print head in this example, comprising a tile 10 which is made of graphite and serves as a support structure for one or more MEMS-chips 12 each of which forms a plurality of ejection units 14 (piezoelectric ink jet printing devices in this example). The ejection units 14 are arranged in two parallel rows extending normal to the plane of the drawing in FIG. 1, so that the cross-sectional view shows two of these ejection units.

As is well known in the art, the chip 12 has a substrate 16 made of silicon, and a flexible wall (designated as "membrane" 18 hereinafter) which is bonded to a bottom face of the substrate 16 so as to cover actuator chambers 20 that have been etched into the bottom face of the substrate 16. Each actuator chamber 20 accommodates a piezoelectric actuator 22 which is attached to the flexible membrane 18 and has electrodes 24, 26 electrically connected to a contacting section 28 of the chip 12.

Another silicon layer 30 of the chip 12 is bonded to the bottom face of the membrane 18 and forms a number of pressure chambers 32 each of which is disposed opposite to one of the actuators 22. The pressure chambers 32 are elongated in a direction x and are connected to ink supply passages 34 which penetrate the substrate 16. On the bottom side, the pressure chambers 32 are delimited by a nozzle plate 36 which forms a number of nozzles 38 disposed such that each nozzle 38 is in fluid communication with the pressure chamber 32 of one of the ejection units.

The tile 10 accommodates an ink supply manifold 40 for supplying liquid ink to the ink supply passages 34 of each of the ejection units 14.

The tile 10 further accommodates heaters (or, more generally, temperature adjusting devices) 42 for heating the chips 12. In this example, it may be assumed that the printer is a hot-melt ink jet printer so that the chip 12 has to be heated to a temperature above the melting point of the ink when the printer is operating.

The substrate 16 of the chip 12 is bonded to the tile 10 by means of a relatively thin adhesive layer 44. Since the material of the tile 10 (graphite) has a coefficient of thermal expansion that is substantially larger than that of the material (silicon) of the substrate 16 of the chip 12, mechanical stress may be induced in the chip 12 due to differential thermal expansion. Such mechanical stress affects the tension of the membrane 18 and, consequently, the jetting behavior of the ejection units 14.

Figure 2:
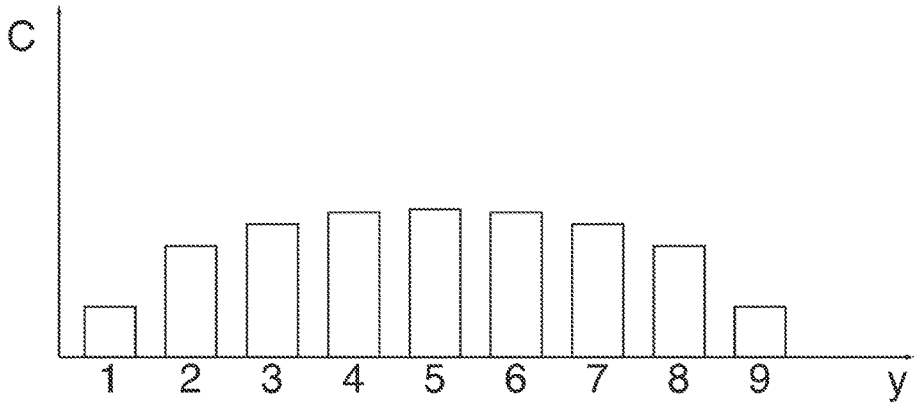
FIG. 2 is a diagram showing a dependency of a compliancy of flexible walls of the ejection units as a function of the position of the ejection unit in the chip.

In a practical embodiment, the tile 10 and the chip 12 are elongated in the direction normal to the plane of the drawing in FIG. 1 and thus normal to the direction x. In FIG. 2 and in the following figures, this direction will be designated as "y". When the ejection device is heated from room temperature to its operating temperature, differential thermal expansion will cause mechanical stresses which are particularly high at the opposite ends of the assembly in the direction y. As a result of the higher mechanical stresses, the compliancy of the membranes 18 tends to be lower for the ejection units 14 at the ends of the chip.

FIG. 2 shows the compliancy C of the membranes 18 as a function of the position of the ejection unit in the direction y, assuming that all ejection units 14 have an identical mechanical design and the chip has been heated to its operating temperature. As can be seen, the compliancy is lowest for the ejection units at the positions 1 and 9 at the opposite ends of the chip.

Figure 3:
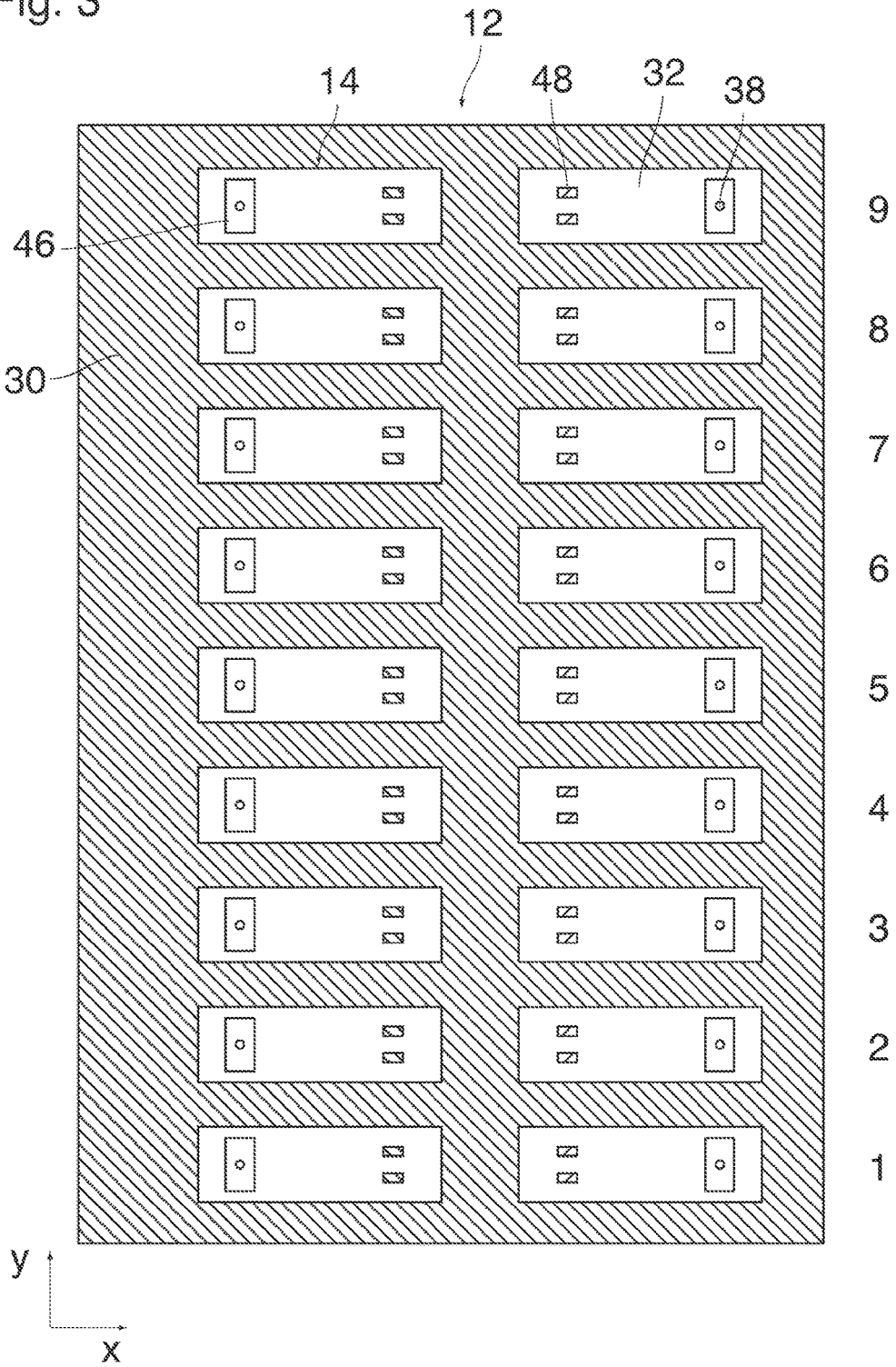
FIG. 3 is a sectional view of the chip in a plane corresponding to the line III-III in FIG. 1.

FIG. 3 is a sectional view of the entire chip 12, taken along the line III-III in FIG. 1, and also shows the positions 1-9 of the ejection units. It will however be observed that, in practice, the number of ejection units in the row extending in the direction y is significantly larger than 9.

FIG. 3 particularly shows the pressure chambers 32 formed in the silicon layer 30 as well as the nozzles 38 in each pressure chamber. Each nozzle has a circular nozzle orifice and a rectangular feedthrough 46 connecting the nozzle orifice to the pressure chamber 32.

As is further shown in FIG. 3, in this example, each pressure chamber 32 has two bumps 48 which are provided for supporting the membrane 18 near the end of the pressure chamber 32 opposite to the nozzle 38.

Figure 4:
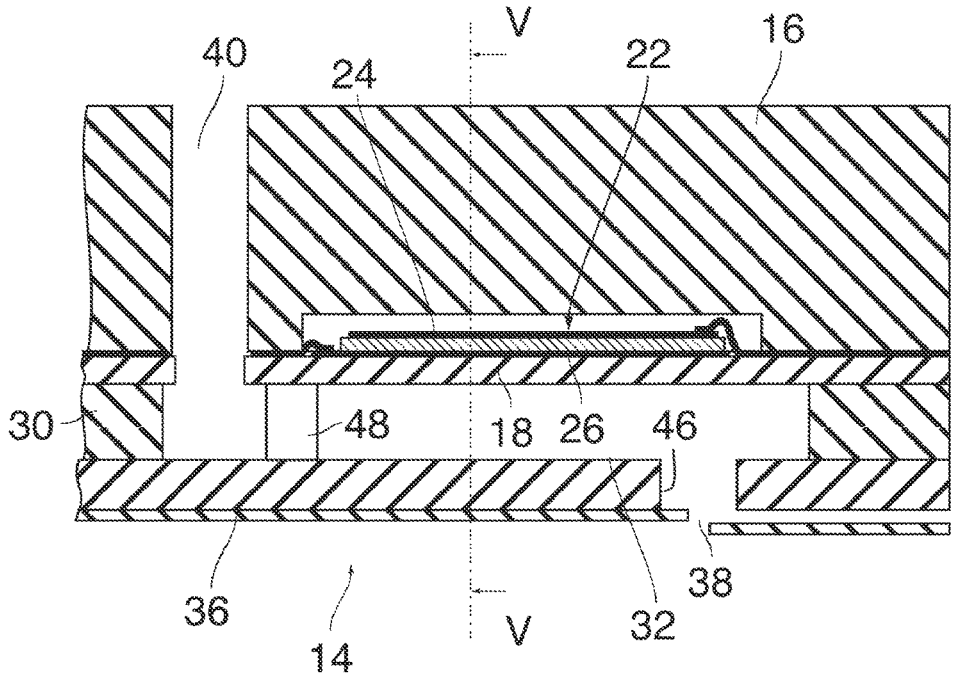
FIG. 4 is an enlarged cross-sectional view of a single ejection unit.

FIG. 4 is an enlarged view of a single ejection unit 14 and shows the feedthrough 46 in the nozzle plate 36 as well as the bumps 48 in the pressure chamber 32.

Figure 5:
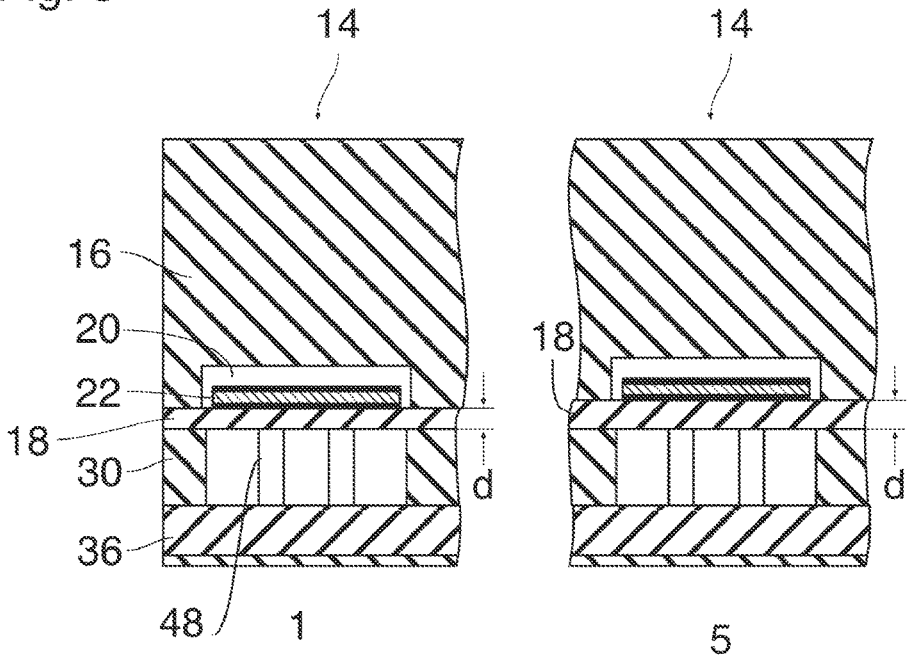
FIG. 5 shows sectional views of two ejection units in an embodiment of the invention, the plane of section being indicated by the line V-V in FIG. 4.

FIG. 5 is a sectional view taken along the line V-V in FIG. 4 and shows two ejection units 14 in a device according to the invention, the ejection units being located at the positions 1 and 5 in FIG. 3. The mechanical designs of the ejection units 14 shown in FIG. 5 are identical, with the exception that the thickness d of the membrane 18 is different for the two ejection units. On the left side in FIG. 5, for the ejection unit in position 1, the membrane 18 has a thickness which is smaller than the thickness of the membrane in the ejection unit at position 5. The decreased thickness of the membrane 18 in position 1 leads to a higher compliancy of the membrane at room temperature. This higher compliancy is to compensate the decrease in compliancy that is induced by the mechanical stresses at operating temperature, as illustrated in FIG. 2.

Depending on the position in the chip, the thickness of the membrane 18 is adjusted for each ejection unit such that the effect of the mechanical stress at operating temperature is compensated and, consequently, all membranes 18 of all ejection units 14 will have an essentially identical compliancy at operating temperature, so that all ejection units will have the same ejection behavior.

Figure 6:
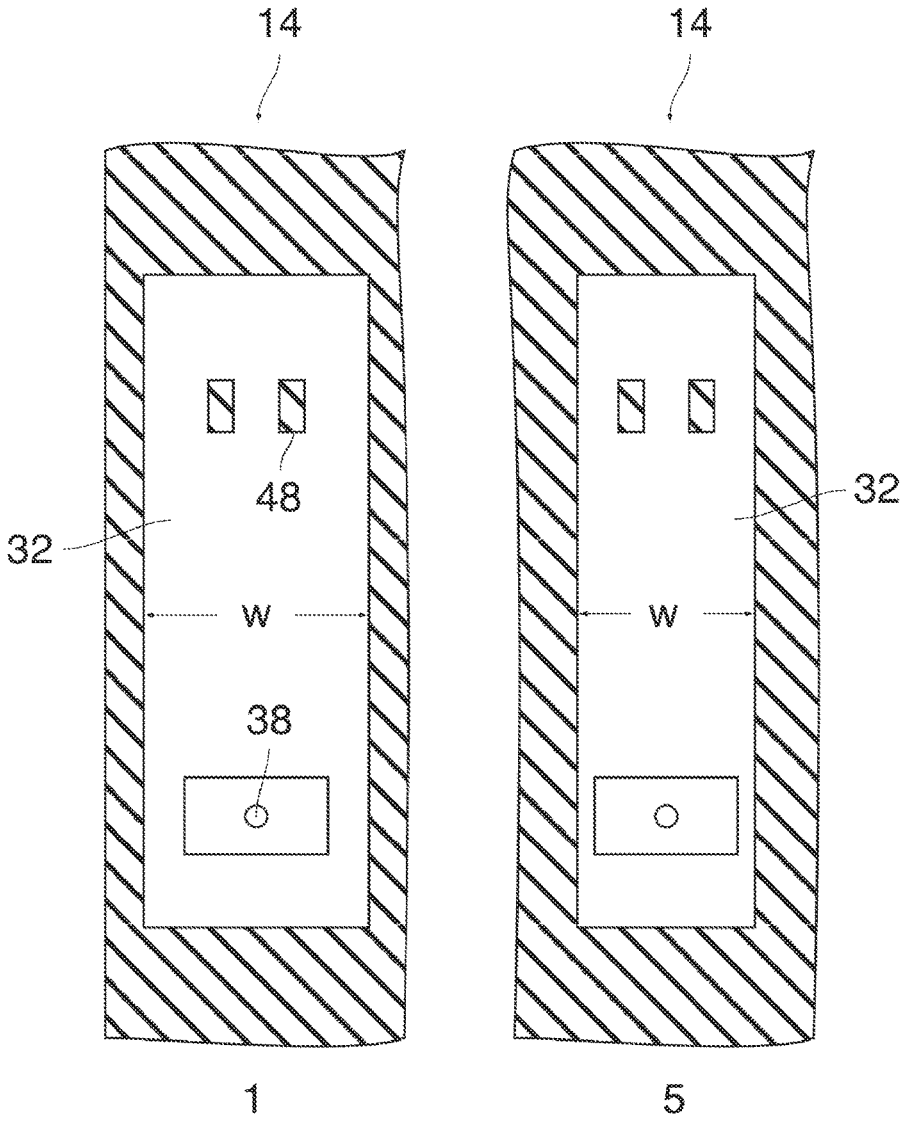
FIG. 6 is an enlarged sectional view of two ejection units in another embodiment, the sectional view being taken in the same plane as in FIG. 3.

Another possibility to adjust the compliancy of the membranes is exemplified in FIG. 6 which shows two ejection units 14 at positions 1 and 5 in a horizontal section as in FIG. 3. Here, the width w of the pressure chamber 32 in position 1 is larger than the width of the pressure chamber in position 5. Since the membrane 18 spans the entire width of the pressure chamber 32, an increased width w means that width of the deflected part of the membrane 18 is also increased, with the result that the membrane can be deformed more easily. Consequently, the compliance of the membrane in position 1 is increased in comparison to the compliance of the membrane in position 5.

Figure 7:
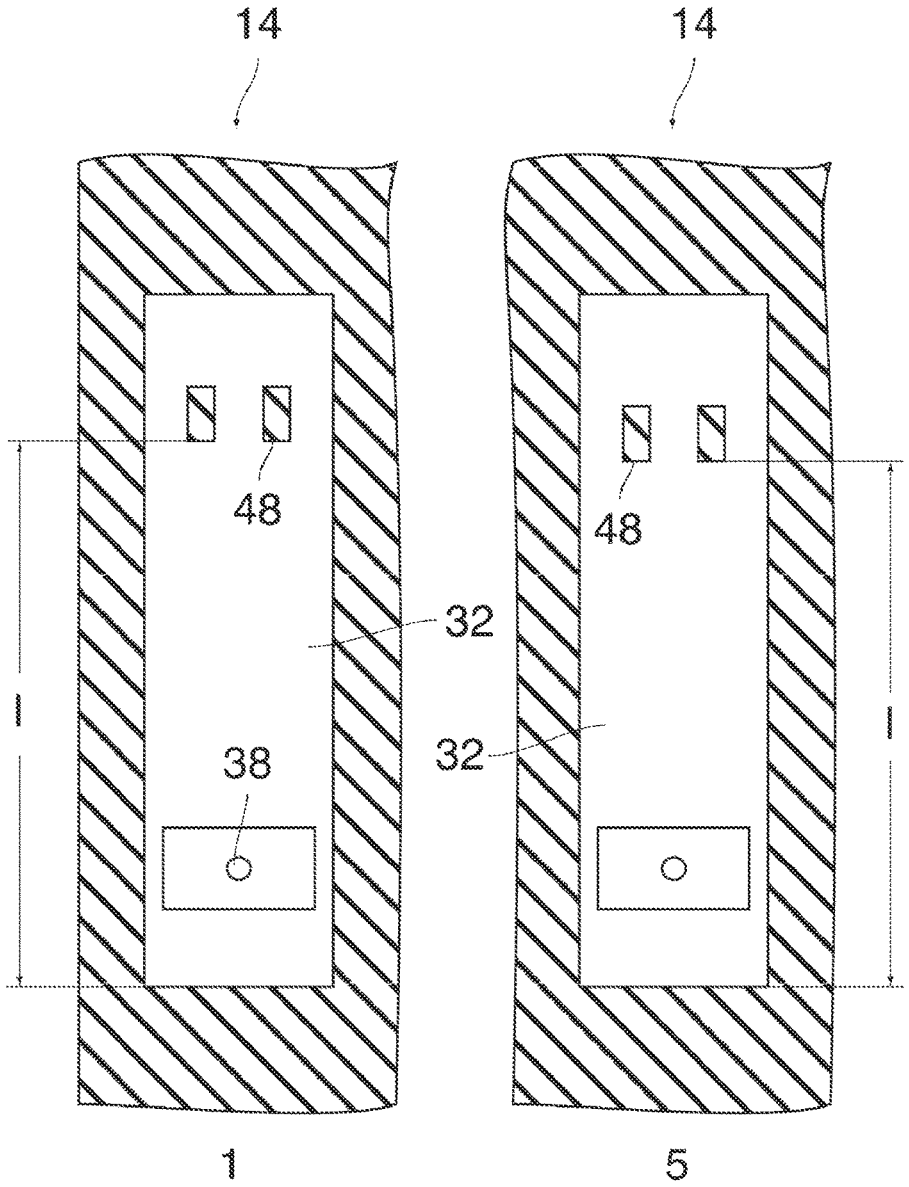
FIG. 7 is a sectional view analogous to FIG. 6, illustrating another embodiment of the invention.

Analogously, the compliance can also be adjusted by varying the length of the pressure chambers 32 and, therewith, the length of the part of the membrane that is allowed to flex. In this specific example, the membrane is supported on the bumps 48, so that the position of the bumps 48 determines the effective length of the flexing part of the membrane 18. FIG. 7 shows an embodiment in which the length l of the flexing part of the membrane 18 has been changed by changing the position of the bumps 48. Thus, the length l from the bumps 48 to the opposite end of the pressure chamber 32 is larger for the pressure chamber in position 1 than for the pressure chamber in position 5. As a result, the compliancy of the membrane in position 1 is increased so as to compensate for the mechanical stress at operating temperature.

The examples shown in FIGS. 6 and 7 have the advantage that the ejection units 14 of the chip differ only in the shape of the pressure chamber 32. Since, in the manufacturing process, the cavities 32 and the bumps 48 formed therein are formed in a single etching step, using only a single etch mask which defines the contours of the pressure chambers and the contours and positions of the bumps 48, all that is required for obtaining a chip according to the invention, instead a conventional chip, is to change the design of a single etch mask.

Figure 8:
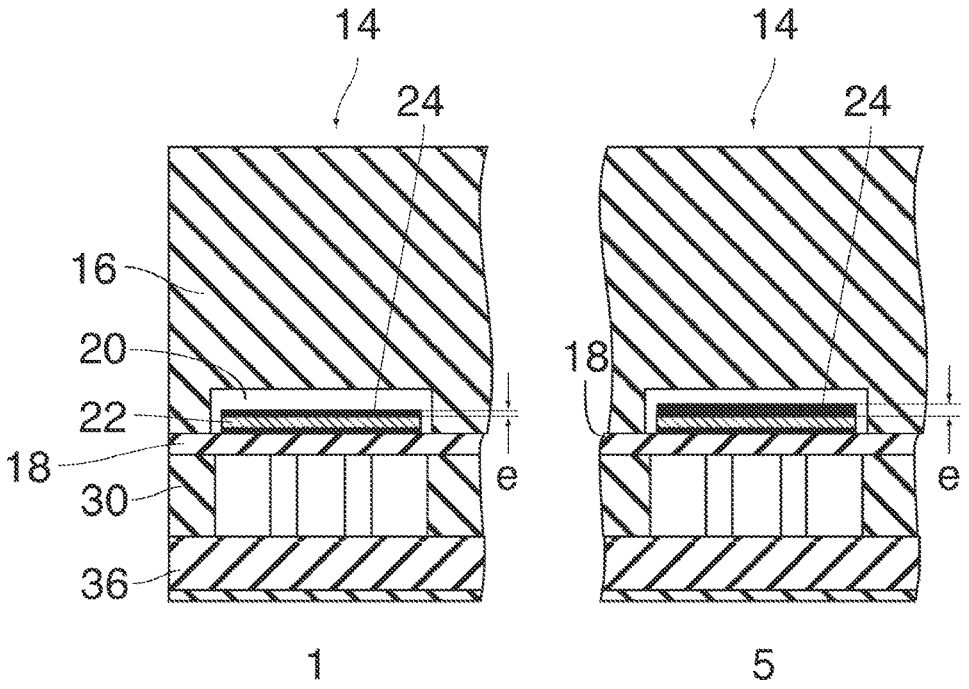
FIG. 8 is a sectional view analogous to FIG. 5, illustrating yet another embodiment of the invention.

Of course, there are other possibilities to adjust the compliancies of the membranes 18. For example the dimensions of the piezoelectric actuators 22 could be modified. As yet another example, FIG. 8 illustrates a case, where, instead of modifying the piezoelectric actuator 22 itself, only the thickness of one of the electrode layers, in this case the layer 24, has been modified. Thus, in this embodiment, the thickness e of the electrode layer 24 in position 1 is smaller than the thickness e of the electrode layer 24 in position 5. Again the result is that the membrane 18 in position 1 can flex more easily and therefore has a larger compliance at room temperature. Heating the chip to its operating temperature will eliminate the differences in the compliancies of the membranes.

In another embodiment the electrode layers 24 may have the same thickness but may be made of different materials so as to have different stiffnesses.

The invention claimed is:

1. An ejection device comprising:

a tile made of a material having a first coefficient of thermal expansion (CTE), a chip attached to the tile, the chip having a plurality of ejection units and in thermal contact with the tile, the chip having a second CTE different from the first CTE, wherein each ejection unit is capable of ejecting droplets of a liquid and comprises a pressure chamber and a flexible wall delimiting the pressure chamber, the flexible wall of each chamber having a deformation compliancy, wherein, in operation at a temperature different from room temperature, the ejection units have uniform ejection properties, and wherein the deformation compliancy of the flexible wall of a first pressure chamber is different than the deformation compliancy of the flexible wall of a second pressure chamber at room temperature.

2. The ejection device according to claim 1, wherein the flexible wall of the first pressure chamber has a different thickness than the flexible wall of the second pressure chamber.

3. A method of manufacturing the ejection device according to claim 2, the method comprising a plurality of etching steps in which a respective etch mask is applied to a layer of the chip, wherein a mechanical design parameter that determines the deformation compliancies of the flexible walls of the ejection units is selected to be a parameter that is determined by only a single etch mask.

4. The ejection device according to claim 1, further comprising an actuator attached to the flexible wall of each ejection unit, wherein the pressure chambers have a length extending in a first direction and a width extending in a second direction, each pressure chamber having a length greater than the width, and wherein a width of the first pressure chamber is different than a width of the second pressure chamber.

5. A method of manufacturing the ejection device according to claim 4, the method comprising a plurality of etching steps in which a respective etch mask is applied to a layer of the chip, wherein a mechanical design parameter that determines the deformation compliancies of the flexible walls of the ejection units is selected to be a parameter that is determined by only a single etch mask.

6. The ejection device according to claim 1, wherein the pressure chambers have a length extending in a first direction and a width extending in a second direction, each pressure chamber having a length greater than the width, wherein the flexible walls of the ejection units have flexing parts extending in the first direction capable of being deformed by an actuator, and wherein a length of the flexing part of the first pressure chamber is different than a length of the flexible part of the second pressure chamber.

7. A method of manufacturing the ejection device according to claim 6, the method comprising a plurality of etching steps in which a respective etch mask is applied to a layer of the chip, wherein a mechanical design parameter that determines the deformation compliancies of the flexible walls of the ejection units is selected to be a parameter that is determined by only a single etch mask.

8. The ejection device according to claim 1, wherein the flexible wall of each ejection unit carries another material layer firmly connected to a flexing part of the flexible wall so as to be deformed together with that flexing part under the action of an actuator, and the additional layers in different ejection units have different stiffnesses.

9. A method of manufacturing the ejection device according to claim 8, the method comprising a plurality of etching steps in which a respective etch mask is applied to a layer of the chip, wherein a mechanical design parameter that determines the deformation compliancies of the flexible walls of the ejection units is selected to be a parameter that is determined by only a single etch mask.

10. The ejection device according to claim 1, wherein an effective volume of the first pressure chamber is greater than an effective of the second pressure chamber.

11. The ejection device according to claim 10, wherein the effective volume is calculated by a width and an effective length.

12. A method of manufacturing the ejection device according to claim 1, the method comprising a plurality of etching steps in which a respective etch mask is applied to a layer of the chip, wherein a mechanical design parameter that determines the deformation compliancies of the flexible walls of the ejection units is selected to be a parameter that is determined by only a single etch mask.

* * * * *